US005797166A

United States Patent [19]

Wagenheim

[11] Patent Number: 5,797,166

[45] Date of Patent: Aug. 25, 1998

[54] CARRYING HANDLE FOR ARTICLES

[76] Inventor: Evan J. Wagenheim, 19132 Fisher Island Dr., Fisher Island, Fla. 33109

[21] Appl. No.: 799,034

[22] Filed: Feb. 10, 1997

[51] Int. Cl.[6] ..... A47B 95/02

[52] U.S. Cl. ..... 16/124; 16/111 R; 16/114 R

[58] Field of Search ..... 16/124, 125, 127, 16/110 R, 114 R, 111 R, DIG. 12; 294/27.1, 28, 29, 30, 31.1, 159, 170, 171; 383/13

[56] References Cited

U.S. PATENT DOCUMENTS

| | | | |
|---|---|---|---|
| D. 137,712 | 4/1944 | Miano . | |
| D. 295,727 | 5/1988 | Clarke . | |
| D. 325,169 | 4/1992 | Montoya . | |
| D. 356,261 | 3/1995 | Miceli, Jr. . | |
| D. 358,094 | 5/1995 | DeGiacomo, Jr. . | |
| D. 361,263 | 8/1995 | Carmo et al. . | |
| D. 362,386 | 9/1995 | Blocker . | |
| D. 362,621 | 9/1995 | Blocker . | |
| D. 362,622 | 9/1995 | Van Davelaar . | |
| 3,115,648 | 12/1963 | Redfield, Jr. . | |
| 4,004,722 | 1/1977 | Oliver . | |
| 4,112,541 | 9/1978 | Tetradis . | |
| 4,590,640 | 5/1986 | Enersen . | |
| 4,596,397 | 6/1986 | Conti | 16/114 R |
| 4,723,740 | 2/1988 | Courtemanche . | |
| 4,837,892 | 6/1989 | Lo | 16/111 R |
| 4,964,192 | 10/1990 | Marui | 16/114 R |
| 5,181,757 | 1/1993 | Montoya . | |
| 5,257,845 | 11/1993 | McConnell . | |
| 5,263,755 | 11/1993 | Thompson . | |
| 5,440,784 | 8/1995 | Hull et al. | 16/124 |
| 5,441,323 | 8/1995 | Goddard . | |
| 5,487,581 | 1/1996 | Carmo . | |
| 5,511,445 | 4/1996 | Hidebrandt | 16/110 R |

FOREIGN PATENT DOCUMENTS

| | | |
|---|---|---|
| 7888 | 2/1980 | European Pat. Off. . |
| 2632933 | 12/1989 | France . |
| 2659626 | 9/1991 | France . |
| 1652208 | 5/1991 | U.S.S.R. . |
| 2255497 | 11/1992 | United Kingdom . |

*Primary Examiner*—Chuck Mah
*Attorney, Agent, or Firm*—Richard C. Litman

[57] ABSTRACT

A carrying handle for various articles, such as grocery bags, clothing hangers, etc., provides an ergonomically beneficial method of carrying such articles. The handle is unitarily and monolithically formed as a single solid, rigid component for maximum strength, and includes a closed handgrip portion with an open hook portion depending from the handgrip portion. All portions of the handle have a convex oval or elliptical cross section, with the major axes of the sections being coplanar with the plane of the handle for maximum strength. The handgrip portion is convex along its upper and lower surfaces, to conform better to the shape of the hand. The handle portion may also include individual finger depressions therein, and/or padding for greater comfort. The lowest central point of the hook portion is aligned precisely below the center of the handgrip, on a line normal to the longitudinal axis of the handgrip, to provide proper balance for articles carried using the present handle. The open area of the hook portion is relatively wide relative to its height so that the captured portions of articles suspended thereon are aligned beside one another, to preclude them from being stacked atop one another or tangled with one another. The slot at the mouth of the open hook portion is narrower than the main area of the hook portion, to reduce slippage of articles therefrom. The device may be formed of a high density plastic for good strength, durability, and economy, or other material as desired.

2 Claims, 3 Drawing Sheets

CARRYING HANDLE FOR ARTICLES

BACKGROUND OF THE INVENTION

1. Field of the Invention

The present invention relates generally to hangers, supports, and the like, and more specifically to an ergonomic handle for carrying various articles thereon. The handgrip of the handle may be padded and is specifically formed for comfort in the hand, with a line from the center of the handgrip through the center of the hanger portion being normal to the axis of the handgrip to provide proper balance in the hand for articles being carried.

2. Description of the Prior Art

In day to day living, it is almost universal for persons to need to carry some relatively heavy, bulky, or otherwise cumbersome article by hand. Accordingly, numerous handgrips, hanger devices, and related tools have been developed to ease the task of carrying such an article. In fact, many bags, boxes, and other containers are now manufactured with handles built in. However, most of these devices are relatively inexpensive, and in fact must be made cheaply when combined with a container, in order to avoid inflating the cost of the container beyond reason. The cheap construction and ill fitting form of many such carriers and handles may result in more harm than good, with the carrier finding it easier to carry the article(s) directly rather than using a separate handle.

Accordingly a need arises for an ergonomic carrying handle for articles, providing good fit and balance to avoid or reduce stress and strain to the hand. The present carrying handle includes numerous features providing comfort for the hand, such as centering the load directly below the center of the handgrip to avoid asymmetric loads on the handgrip, padding the handgrip, forming at least the handgrip portion in an oval or elliptical cross section for greater comfort, and other features. A discussion of the prior art of which the present inventor is aware, and its differences and distinctions from the present invention, is provided below.

U.S. Pat. No. 3,115,648 issued on Dec. 31, 1963 to Paul H. Redfield Jr. describes a Combination Bale Hook And Twine Cutter, comprising a closed loop handgrip having a lifting hook and cutting blade extending from the closed grip. The lifting hook and cutting blade are laterally offset from one another so that neither is centered beneath the handgrip, unlike the present invention. The device is formed of a stamped sheet of material, with the handgrip folded over to avoid cutting into the hand. No padding or oval or elliptical cross section is disclosed, as in the present handle.

U.S. Pat. No. 4,004,722 issued on Jan. 25, 1977 to Lynn Olivier describes a Handle Device having a rounded, smooth, closed handgrip portion with a slot therebelow and parallel thereto for the article carrier portion. The slot may be considered as a very narrow and elongated "hook" for suspending articles therefrom, but the axis of its opening is parallel to the handgrip, rather than perpendicular thereto, as in the present handle.

U.S. Pat. No. 4,112,541 issued on Sep. 12, 1978 to Constantinos Tetradis describes a Handle For Bags Particularly Of Net Or Plastic Material. The device includes a closed loop handgrip, but the grip has a straight, relatively narrow lower edge which would rest upon the hand in use, and includes concave central portions due to the relatively thin web between the upper and lower edges of the handgrip portion. The article carrier portion of the device is flexible, and is bent back upon itself to sandwich the upper portion of the bag or flexible article therebetween to support the article. The present handle includes convex cross sections throughout for greater comfort, and is formed of rigid materials resistant to bending.

U.S. Pat. No. 4,590,640 issued on May 27, 1986 to Richard W. Enersen describes a Handle For Plastic Bag comprising a generally smoothly rounded and convex grip portion with the article carrying portion comprising a generally concentric channel formed along the center of the grip and parallel thereto. The article carrying portion is not a separate portion of the device extending below the handgrip portion, as in the present invention.

U.S. Pat. No. 4,723,740 issued to Richard Courtemanche et al. on Feb. 9, 1988 describes a Support Hook For Plastic Bag, comprising a relatively narrow support hook adapted to hook over the edge of a rigid container (box, etc.) with an arcuate article support extending therebelow. No handgrip portion is provided, and the article is not adapted to be carried in the hand of a person, as provided by the present carrying handle.

U.S. Pat. No. 5,181,757 issued on Jan. 26, 1993 to Arturo T. Montoya describes a Plastic Bag Carrier having an open handgrip portion and three narrow slots along a parallel arm therebelow, for engaging a loop of material from a plastic bag. None of the bag engaging slots is directly beneath the center of the handgrip portion, as provided by the present handle, and the general configuration of the device is that of a flanged web, similar to the Tetradis carrier discussed further above, rather than being a smoothly rounded convex shape throughout as provided by the present handle.

U.S. Pat. No. 5,257,845 issued on Nov. 2, 1993 to Michael J. McConnell describes a Detachable Hand Grip For Carrying Bags And The Like, comprising a flexible, flat, planar sheet having a slot formed in each end. A bag or narrow bale or the like is captured within the slots, with the central portion of the grip being flexibly folded around the bag or bale passing thereacross. The flexible and planar configuration of the McConnell device are completely different from the present handle.

U.S. Pat. No. 5,263,755 issued on Nov. 23, 1993 to Steven C. Thompson describes a Portable Carrier comprising a generally D-shaped combined handle and carrier when the device is closed. The device may be opened so the closed loop handles of bags or the like may be placed over the open curved portion, and then reclosed with the straight side of the closed D-shape serving as the handgrip. The components of the device are rectangular in section, unlike the rounded sections of the present monolithic handle.

U.S. Pat. No. 5,441,323 issued on Aug. 15, 1995 to Scott H. Goddard describes a Carrier For Bags Having Straps And Method Of Use, comprising a handgrip portion with an article carrier portion cantilevered from one end thereof. A ring may be used to close the opposite end of the two portions. The handgrip portion is adapted to be held at a fourteen degree angle from the horizontal to position the lowermost portion of the article carrying portion directly below the wrist. However, this asymmetric configuration results in the highest portion of the hand (e.g., the smallest and weakest little finger, as shown in FIGS. 7 and 8 of the Goddard patent) actually supporting a disproportionate share of the load, as the closed end rests against the little finger of the hand. If the grip is moved upwardly and rearwardly to preclude such pressure, it will rend to slide forwardly and downwardly in the hand to resume this natural state of asymmetric load upon the hand.

U.S. Pat. No. 5,487,581 issued on Jan. 30, 1996 to Robert A. Carmo et al. describes a Hand Grip For Carrying Heavy Plastic Bags, comprising a closed handgrip portion with an open article carrier hoots extending below the handgrip. Several embodiments are disclosed, with that of FIGS. 1 and 2 bearing some superficial resemblance to the present article carrier. However, the device does not provide an oval or elliptical cross section for maximum strength and comfort in the hand, but has a flanged web configuration with concave side portions. Also, no padding for the handgrip portion is disclosed in this or any of the other devices of the prior art.

U.S. Pat. No. D-137,712 issued on Apr. 18, 1944 to Joseph E. Miano illustrates a design for a Package-Handle Or Similar Article, comprising a flat, planar device with a closed loop handgrip portion and two laterally offset article carrier hooks therebelow. The Miano design is more closely related to the device of the Redfield, Jr. '648 utility patent discussed further above, than to the present invention.

U.S. Pat. No. D-295,727 issued on May 17, 1988 to Francis A. Clarke illustrates a design for a Bag Holder in the form of an open, generally C-shaped hook. The handgrip portion is not closed and separate from the carrier portion, as in the present carrying handle, and the sides of the grip are indented, unlike the uniformly convex elliptical configuration of the present carrier.

U.S. Pat. No. D-325,169 issued on Apr. 7, 1992 to Arturo T. Montoya illustrates a design for a Bag Carrier having a configuration similar to that of the '757 U.S. Utility Patent to the same inventor and discussed further above. The design is flat and planar, however, with no apparent curvature being provided for any of the components to ease stress and strain on the hand of the user and/or the article being carried.

U.S. Pat. No. D-356,261 issued on Mar. 14, 1995 to Francis G. Miceli, Jr. illustrates a design for a Device For Carrying Shopping Bags, having an appearance somewhat resembling the present invention. However, several differences are noted: (1) the Miceli, Jr. hook portion extends beyond the closed handle portion, whereas the hook portion of the present device is shorter than the closed handgrip portion thereabove; (2) the Miceli, Jr. article carrying hook and intermediate portions are both considerably thinner than the handgrip itself, while each of the components of the present invention have the same thickness for added strength; (3) the upper side of the Miceli, Jr. handgrip is straight and does not fill the palm of the hand, as does the present grip; (4) the lowest point of the Miceli, Jr. hook is not centered beneath the handgrip portion of the design, as is provided in the present invention; and (5) Miceli, Jr. does not disclose any form of padding for his handgrip, as may be provided for the present article carrier. Numerous other smaller, but still important, distinctions are also noted.

U.S. Pat. No. D-358,094 issued on May 9, 1995 to Michael DeGiacomo, Jr. illustrates a design for a Bag Carrier having a generally C-shaped configuration. The DeGiacomo, Jr. design bears a closer resemblance to the design of the '727 design patent to Clarke discussed above, than to the present article carrier.

U.S. Pat. No. D-361,263 issued on Aug. 15, 1995 to Robert A. Carmo et al. illustrates a design for a Hand Grip For Carrying Articles, related to the device of their '581 U.S. Utility Patent and discussed further above. The same differences and distinctions are seen to apply here.

U.S. Pat. No. D-326,386 issued on Sep. 19, 1995 to James S. Blocker illustrates a Grocery Bag Carrier having a generally S-shaped configuration, with opposite open handgrip and article carrier portions. No substantial resemblance is seen to the present invention.

U.S. Pat. No. D-362,621 issued on Sep. 26, 1995 to James S. Blocker illustrates a Grocery Bag Carrier having a generally C-shaped configuration with a single opening between the hand grip portion and the article carrying hook portion. The open handgrip and lack of an intermediate crossmember, both of which are provided in the present article carrier, render design of the Blocker '621 patent distinct from the present invention.

U.S. Pat. No. D-362,622 issued on Sep. 26, 1995 to Peter C. Van Davelaar illustrates a design for a Bag Carrier having a configuration somewhat like that of the '137 U.S. Design Patent to Miano discussed further above, but with the Van Davelaar design having four hooks depending from the closed handgrip portion with each of the hooks oriented in the same direction. None of the hooks are centered below the handgrip portion, as provided by the single hook of the present invention, and the Van Davelaar design is flat and planar with a flanged web in one side thereof, unlike the smoothly rounded convex elliptical sections of the present invention.

European Patent Publication No. 7888 published on Feb. 6, 1980 to Mario Fioretti illustrates a carrier for shopping bags having a generally C-shaped configuration. The device more closely resembles the designs disclosed in the U.S. Design Patents '727 to Clarke and '094 to Blocker, than the present invention.

French Patent Publication No. 2,632,933 published on Dec. 22, 1989 to Denis P. Schussler illustrates a carrying handle having overlapping handgrip portions separated by a slot through which a closed loop may be passed into the article carrying portion. The article carrying portion is closed when the two overlapping handgrip portions are squeezed together while carrying an article suspended by the device. The flexible nature of the design and the single loop formed when the grip portions are squeezed closed, provide a device which is structurally dissimilar to the present invention.

Soviet Patent Publication No. 1,652,208 Published on May 30, 1991 to V. I. Krinichnyi illustrates a handle for carrying a plastic bag type package, having a fixed crossmember against which a movable crossmember may be secured to clamp an article therebetween. The rigid and monolithic structure of the present carrier is unlike the device of the Soviet '208 patent publication.

French Patent Publication No. 2,659,626 published on Sep. 20, 1991 to J. P. Toledano illustrates a carrying handle, e.g. for carrier bags, having a generally D-shaped configuration with a selectively openable closure at one end through which bag handles or the like may be placed. The single article carrying portion and handgrip portion, particularly in consideration of the separate moveable closure ring for the structure, are not at all similar to the separate closed carrying handle and open hook portions of the rigid monolithic structure of the present invention.

Finally, British Patent Publication No. 2,255,497 published on Nov. 11, 1992 to Gerald N. Rosenthal et al. describes A Blank For A Shopping Bag Carrying Handle, comprising a flat, planar sheet of material with plural lateral fold lines thereacross. The blank is folded along the fold lines to form a handle, with a loop of material from the article being carried, being held in the fold. No similarity is seen to the present handle, with its rigid, monolithic structure, closed carrying handle, open hook portion depending below the carrying handle portion, elliptically rounded cross sections, and other ergonomic features.

None of the above inventions and patents, either singly or in combination, is seen to describe the instant invention as claimed.

SUMMARY OF THE INVENTION

The present invention comprises a carrying handle for articles, providing for the ergonomic carriage of various articles which may be suspended from the handle. The handle essentially includes a closed handgrip portion with an open hook portion depending therefrom. The device is formed as a unitary, monolithic structure having a smoothly rounded shape for all portions thereof, with oval or elliptical cross sections for all portions. The handgrip portion is contoured to fit the hand well, and the lowermost central point of the hook portion is aligned precisely along a line normal to the axis of the handgrip portion and centered thereon, for proper balance of the load being carried. Padding or cushioning may be installed to the handgrip.

Accordingly, it is a principal object of the invention to provide an improved carrying handle for articles which provides ergonomic benefits to the user thereof while carrying articles.

It is another object of the invention to provide an improved carrying handle which comprises a closed handgrip portion with an open hook portion depending therefrom and coplanar therewith.

It is a further object of the invention to provide an improved carrying handle which is formed as a unitary, monolithic component.

An additional object of the invention is to provide an improved carrying handle which is formed of a solid material having a convex oval or elliptical cross section in each portion thereof, to provide maximum strength as well as comfort for a user thereof.

Still another object of the invention is to provide an improved carrying handle which may include padding or cushioning about the handgrip portion thereof.

Yet another object of the invention is to provide an improved carrying handle which hook portion is positioned below the handgrip portion so as to provide proper balance in the hand when an article is being carried.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
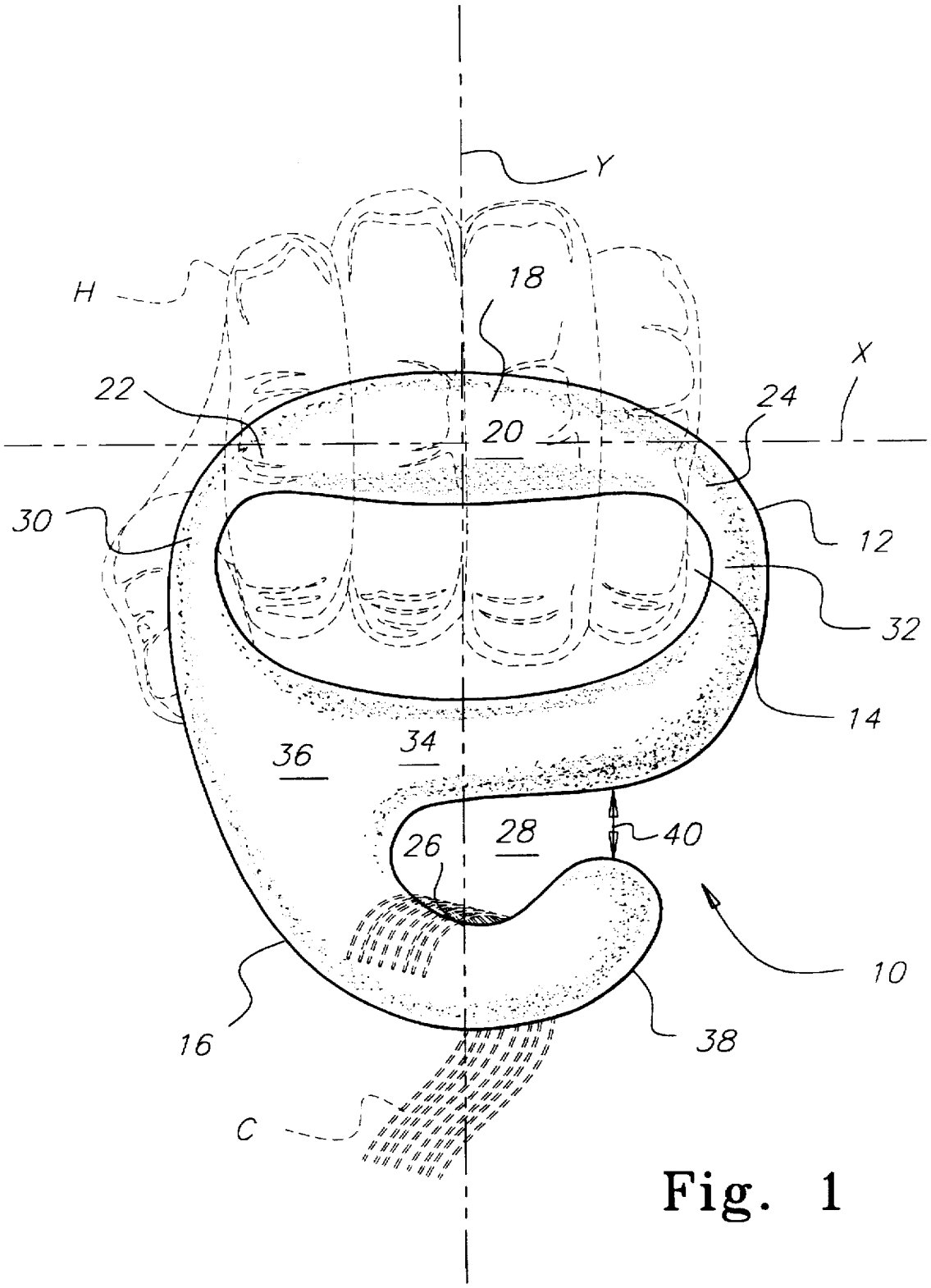
FIG. 1 is a front elevation view of the present carrying handle in use, showing its various features and ergonomic benefits.

The present invention comprises a carrying handle for articles or article carrier which provides ergonomic benefits in the support or carriage of articles, such as shopping bags B, clothing hangers C, etc., therefrom. FIG. 1 provides a front elevation view of one embodiment of the present article carrier, designated with the numeral 10 in the drawings. The article carrier 10 is formed (injection molded or other suitable process) as a single, unitary, monolithic device of a solid sturdy plastic material, such as high density polyurethane or other suitable material. Other materials may be used as desired, such as different plastics or even metals of various types (aluminum, etc.) as desired.

The present carrier 10 generally comprises a closed loop handgrip portion 12 having a hand passage 14 therethrough, with an open hook portion 16 depending from the handgrip portion 12. The handgrip portion 12 includes a grip 18 extending across the upper portion of the handgrip portion 12. The grip 18 is preferably being formed with smoothly rounded, compound convex curvatures to provide a comfortable and ergonomic fit for the hand H of a user of the carrier 10, as shown in FIG. 1, and includes a relatively wide and thick central portion 20 having a greater thickness than its opposite first and second end portions 22 and 24. The compound convex curvature of the grip 18 serves to fill the hand H of a user of the present article carrier or carrying handle 10, and the smoothly rounded contours are devoid of sharp edges in order to enable relatively heavy loads to be carried without discomfort or damage to the hand H of a person carrying the device 10.

It will be noted in FIG. 1 that the grip 18 is laterally symmetrical along a horizontal axis X, with a vertical axis Y normal thereto and extending through the center of the generally symmetrical handgrip portion 12 and article carrier 10. The lowermost point 26 of the article carrier passage 28 of the lower open hook portion 16 also lies along this vertical axis X. Thus, any articles placed within the article carrier passage 28 will tend to gravitate to this lowermost point 26 along the upper surface of the hook 16, and will be centered directly below the intersection of the horizontal and vertical axes X and Y and the center of the grip 18, to balance the load in the hand H.

The closed loop handgrip portion 12 of the present article carrier or carrying handle 10 is formed of four elements: The grip portion 18 discussed further above, opposite first and second end elements 30 and 32 which depend respectively from the first and second ends 22 and 24 of the grip 18, and a downwardly curved intermediate member 34 which extends between the lower ends of the two end elements 30 and 32. The intermediate member 34 lies between the grip 18 and the hook portion 16, and the downward curve of the intermediate member 34 provides additional room in the hand passage 14 for the hand H of a user of the device, as well as narrowing the article carrying passage 28 of the hook portion 16, thereby capturing more securely any articles placed therein.

It will be noted that the two end elements 30 and 32 are somewhat narrower or thinner than the other elements discussed thus far, i.e., the grip 18, the intermediate member 34, and the hook portion 16. No great mass is required for the intermediate members 34, as they are not subject to any significant bending loads due to the closed loop configuration of the hand grip portion 12 of the present carrying handle 10. This allows the overall width of the device to be somewhat less than might be required if the handgrip portion 12 were cantilevered from one side, as in the case of the open hook portion 16, and still provide the required strength and clearance for a hand H through the hand passage 14.

It will also be noted that the hook portion 16 is somewhat narrower laterally than the span of the handgrip portion 12.

Figure 5:
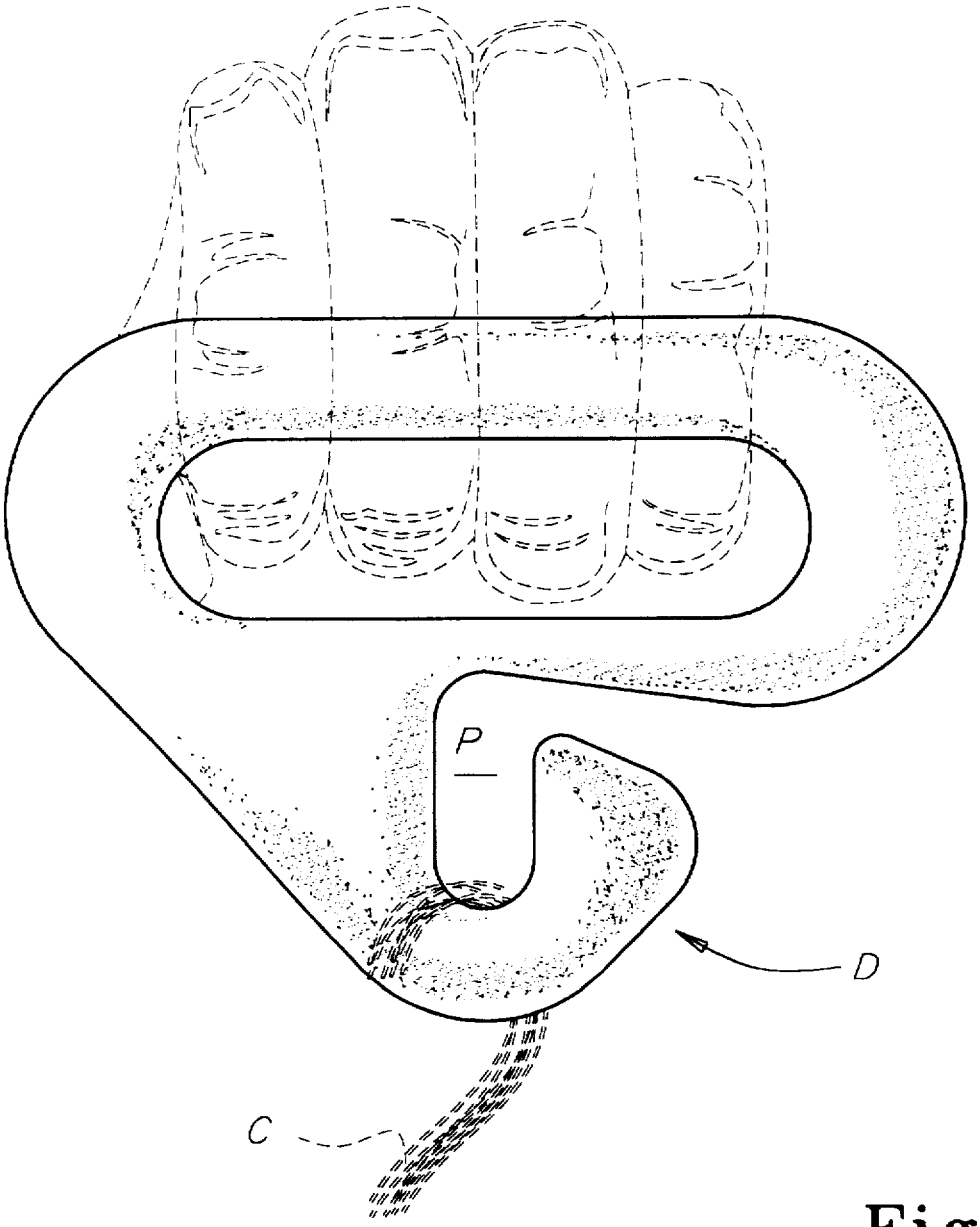
Fig. 5 PRIOR ART
FIG. 5 is an elevational view of a prior art article carrier.

This configuration provides great strength for the hook portion 16, as the relatively short length of the hook portion 16 precludes significant bending stresses at the connecting flange area 36 which connects the hook portion 16 and handgrip portion 12 together. The relatively wide and massive connecting flange 36 also provides significant strength for the hook portion 16, which itself is relatively heavy. However, even though the hook portion 16 is relatively short, it will be seen that the article carrier passage 28 therein is relatively wide in comparison to its height. This allows articles, such as the clothing hangers C shown in broken lines in FIG. 1, to lie beside one another along the upper surface of the hook portion 16, unlike the prior art device D of FIG. 5 wherein the article carrier passage P is relatively tall and narrow, causing articles such as the clothing hangers C carried therein to bunch together and tangle as shown.

Even though the hook portion 16 of the present article carrier 10 is relatively narrow, it will be seen that reasonable security is provided for articles carried thereon due to the upturned distal end 38 of the hook portion 16. This upturning of the distal end 38 places that end 38 closer to the intermediate member 34 than is the lowermost point 26 along the upper surface of the hook portion 16, thereby defining a relatively narrow mouth 40 for the hook portion 16 to retain articles more securely which are placed upon the hook portion 16 and lessen their likelihood of slipping off.

Figure 2:
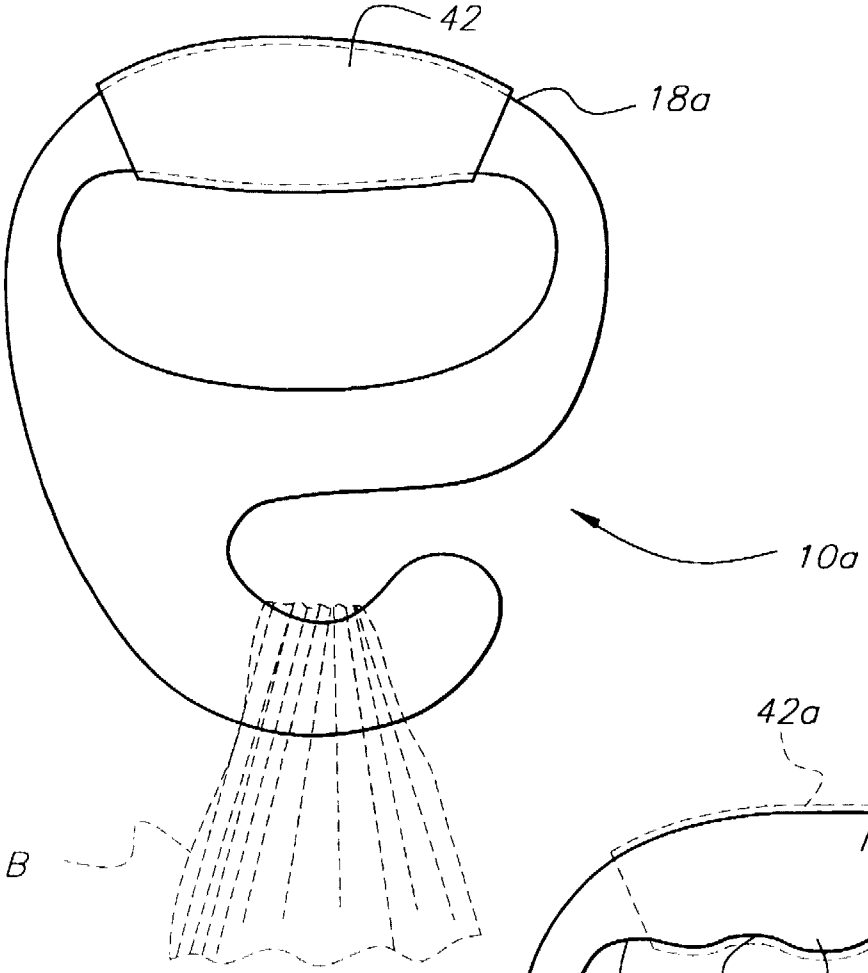
FIG. 2 is a front elevation view of an alternate embodiment having a padded handgrip.

FIG. 2 is a front elevation view of an alternative embodiment of the present article carrier, designated as carrying handle 10*a*. The article carrier or carrying handle 10*a* of FIG. 2 is essentially identical to the carrier handle 10 of FIG. 1 described above, with one important exception: The carrier handle 10*a* of FIG. 2 includes padding 42 disposed about the grip 18*a* of the handgrip portion 12*a* of the device 10*a*. Such an upholstered or padded grip 18*a* may be covered with a resilient elastomer material, such as a closed cell foam material, neoprene, etc., as desired. Alternatively, liquid plastic materials may be used to coat the grip 10*a*, with the material forming a secure bond and perfect conformance to the contours of the grip 10*a* as it cures.

Figure 3:
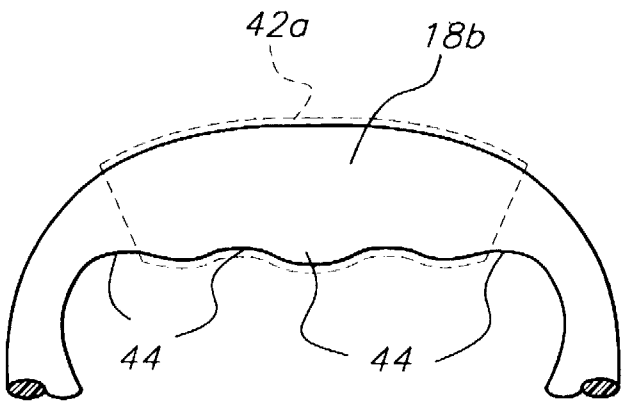
FIG. 3 is a front elevation view, broken away, of an alternate embodiment of the handgrip portion showing individual finger depressions formed therein and alternative padding.

FIG. 3 discloses a further grip embodiment, where a grip 18*b* includes several smoothly rounded ergonomic finger depressions 44 therein. The purpose of these depressions 44 is essentially the same as that of the padding 42 discussed above, i.e., to provide a more positive grip for a user of the present carrier in any of its embodiments, and further to better distribute the load being transferred from the grip of the carrier to the user's hand for more comfort and less stress and strain on the hand. Preferably, four depressions 44 are provided in the lower surface of the grip 18*b*, spread evenly and symmetrically along the grip 18*b* as shown in FIG. 3. Thus, the grip 18*b* may be picked up from either side and will provide equal comfort in either orientation. The grip 18*b* of FIG. 3 may also be combined with padding 42*a*, similar to the padding 42 discussed above and shown in broken lines in FIG. 3.

Figure 4:
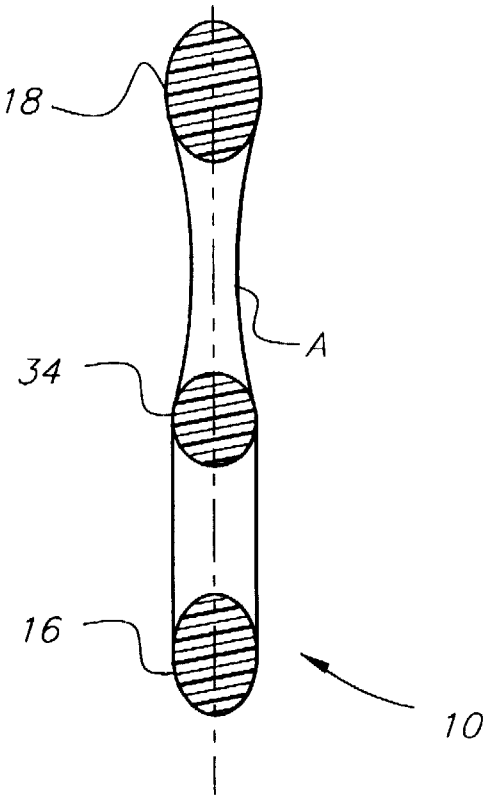
FIG. 4 is a cross sectional elevation view of the present carrying handle, showing the oval or elliptical cross section of each of the lateral portions thereof.

FIG. 4 provides a cross sectional view of the carrying handle or article carrier 10 of the present invention, showing the shapes and configurations of the various components thereof. Preferably, each of the components of the present carrying handle 10 are smoothly rounded and have a round, oval, or more preferably an elliptical and solid cross section, as shown with the grip 18, intermediate member 34, and hook portion 16 of FIG. 4. Such a cross sectional shape provides the greatest strength for the amount of cross sectional area of the components, and also provides the smoothly rounded convex contours desired for greatest comfort for a user of the device.

It will also be noted that the entire carrying handle 10 has a generally flat, planar configuration, with both the handgrip portion 12 and hook portion 16 defining a single plane A to lie coplanar with one another, as shown in FIG. 4. Thus, any loads imposed upon the hook portion 16 will pull directly downwardly through the handgrip portion 12, with the only asymmetric bending load being imposed by the open hook portion 16 to the handgrip portion 12 by the wide and massive connecting flange 36 between the hook portion 16 and the handgrip portion 12, with the size and mass of the connecting flange 36 being adapted for the transfer of such loads as required without danger of damage to the device. The same coplanar configuration of the handgrip portion and hook portion will be seen to extend to the alternative embodiments of the present carrying handle or article carrier of FIGS. 2 and 3 as well.

In summary, the present carrying handle or article carrier will be seen to provide a considerable advance over the various other devices of the prior art. The massive and substantial construction of the present device, using sturdy and durable materials such as high density plastics, or even metals if desired, provides an extremely sturdy tool for the carriage of virtually any practicable article adaptable for such carriage using the present device. The smoothly rounded contours eliminate sharp edges and corners, thus eliminating any hazard to the hand of a user of the device. The smoothly rounded contours, including the distal end of the hook portion, also allow the device to be carried within a pocket or purse without concern of fabric or other material being snagged or torn, as may occur with some other devices of the prior art.

The use of padding and/or finger depressions in the grip portion of the handgrip also provide further comfort for a user of the device, which translates to greater carrying capacity. The relatively wide carrying hook opening also distributes the load being carried to a greater degree than many devices of the prior art, and the alignment of the bottom of the hook portion with the center of the grip assures the even distribution of loads being carried to the hand of the user. Yet, the device is relatively economical to manufacture, and may be imprinted or marked to advertise various products and services if desired. Alternatively, the materials used are amenable to coloring, to provide a colorful and attractive tool which stands out and is not prone to being lost.

Thus, the present carrying handle or article carrier will be seen to have wide ranging utility for virtually anyone having need to carry bags, hangers, and other articles which may be equipped with some form of handle, but which is nevertheless awkward at best to use. The ergonomic benefits of the present device will provide all persons, but particularly the aged and those with arthritis or other handicaps, with the means for further self sufficiency which was heretofore unavailable with earlier article carriers exemplified in the prior art.

It is to be understood that the present invention is not limited to the sole embodiments described above, but encompasses any and all embodiments within the scope of the following claims.

I claim:

1. A carrying handle for articles, comprising:

a closed loop handgrip portion having a hand passage therethrough, and an open hook portion depending from said handgrip portion, said handgrip portion and said open hook portion formed as a unitary solid construction of sturdy plastic, said hook portion being laterally narrower than said handgrip portion, said closed handgrip portion disposed coplanar with said open hook portion;

said handgrip portion including an upper grip extending along a horizontal axis, said grip being symmetrical about a central vertical axis normal to the horizontal axis and including a first end and an opposite second end, said grip having an ergonomic shape defined by an upper edge and a lower edge, each said edge having a convex curvature, said handgrip portion having a first end element depending from said first end and an opposite second end element depending from said second end, said handgrip portion further including an intermediate member connecting said first end element and said second end element, each said end element being thinner than said grip, said intermediate member, and said hook portion, said intermediate member being downwardly curved away from said grip, said grip and said intermediate member each having a solid elliptical cross section;

a padded covering surrounding said grip;

said hook portion having an upwardly turned distal end and a wide article support area, said distal end being closer to said handgrip portion than said article support area of said hook portion to define an article carrier passage having a narrow mouth for retaining articles securely within said hook portion, said article carrier passage having a height and a width, said height being less than said width, said article support area having a lowermost central point disposed on said central vertical axis, said article support area having a solid elliptical cross section, said hook portion having a wide connecting flange connected to said intermediate member.

2. The carrying handle according to claim 1, wherein said lower edge of said grip includes a plurality of smoothly rounded ergonomic finger depressions formed laterally therein.

* * * * *